US005174235A

United States Patent [19]

Moody

[11] Patent Number: 5,174,235

[45] Date of Patent: Dec. 29, 1992

[54] APPARATUS FOR PRESSURIZING A SUBMARINE LAUNCH TUBE

[75] Inventor: Paul E. Moody, Barrington, R.I.

[73] Assignee: The United States of America as represented by the Secretary of the Navy, Washington, D.C.

[21] Appl. No.: 904,095

[22] Filed: Jun. 25, 1992

[51] Int. Cl.[5] ..... B63B 1/00

[52] U.S. Cl. ..... 114/238; 124/65; 114/318

[58] Field of Search ..... 114/316-319, 114/238, 239; 124/63-67; 89/1.809

[56] References Cited

U.S. PATENT DOCUMENTS 2,848,970 8/1958 Gunning ..... 114/238

*Primary Examiner*—Edwin L. Swinehart

*Attorney, Agent, or Firm*—Michael L. McGowan; Prithvi C. Lall; Michael F. Oglo

[57] ABSTRACT

An apparatus for pressurizing a submarine launch tube in order to launch a device therefrom includes a weighted first piston received in a vertically disposed first cylinder member, a second piston received in a second cylinder member, a connecting rod mechanically connecting the first and second pistons and a conduit connecting the second cylinder member to a launch tube. The first piston member is constructed such that downward gravitational movement thereof in the first cylinder member is operative for moving the second piston member in the second cylinder member in order to force water received in the second cylinder member outwardly under pressure through the conduit and into the launch tube.

7 Claims, 1 Drawing Sheet

APPARATUS FOR PRESSURIZING A SUBMARINE LAUNCH TUBE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The instant invention relates to a launch apparatus and more particularly to an apparatus for pressurizing a launch tube in order to eject a device therefrom.

(2) Description of the Prior Art

The heretofore available apparatus for pressurizing the submarine launch tubes have generally comprised means for injecting high pressure water into the breech ends of the launch tubes in order to force devices outwardly therefrom against the forces of sea water pressure. Further, the means for injecting high pressure water into the breech ends of launch tubes of apparatus of this type have generally involved the use of an air-powered ram. However, it has been found that the noise produced by air-powered rams of this type can contribute significantly to the acoustic emissions, i.e., signatures associated with launching devices from launch tubes. Hence, it has been found that there is a significant need for an apparatus which is operative for pressurizing the breech end of a launch tube with high pressure water without producing an excessive amount of noise.

SUMMARY OF THE INVENTION

The invention provides an effective apparatus which is operative for pressurizing the breech end of a launch tube without producing a significant amount of noise.

More specifically, the invention provides an apparatus for pressurizing a launch tube comprising a gravitationally driven piston assembly which is operative for injecting high pressure water into the breech end of the launch tube in order to launch a device therefrom. Still more specifically, the apparatus of the invention includes a vertically disposed first cylinder member, a second cylinder member, a weighted first piston member in the first cylinder member, a second piston member in the second cylinder member, and rigid connecting means connecting the first piston member to the second piston member for movement together between upper first positions thereof and lower second positions thereof in the respective cylinder members thereof. The first and second piston members are preferably disposed in vertically aligned relation and the connecting means is preferably operative for mechanically connecting the first and second piston members for movement together between the respective first and second positions thereof. The second cylinder member has an outlet formed in the lower end portion thereof, and the apparatus further includes a conduit extending from the outlet in the lower end portion of the second cylinder member to the breech end of a launch tube. Accordingly, when the second piston member is moved downwardly by the first piston member, the second piston member is operative for forcing water received in the lower end portion of the second cylinder member outwardly through the conduit so that the water is injected under pressure into the breech end of the launch tube. The first piston member is formed so that the weight thereof is sufficient to gravitationally move the first and second piston members from the upper first positions thereof to the lower second positions thereof and to thereby force pressurized water outwardly from the lower end portion of the second cylinder member through the conduit and into the breech end of the launch tube. The apparatus preferably further includes a venting system for selectively venting the lower end portion of the first cylinder member in order to selectively control the descent of the first piston member and shock noise isolator means for mounting the first and second cylinder members so that they are substantially acoustically isolated from the mounting structure.

It has been found that the apparatus of the instant invention can be effectively utilized for pressurizing a launch tube without creating an excessive amount of noise. Specifically, it has been found that by utilizing a weighted first piston member for gravitationally powering the apparatus of the subject invention, a high pressure water stream can be applied to the breech end of a launch tube without producing a significant amount of noise.

BRIEF DESCRIPTION OF THE DRAWING

A more complete understanding of the invention and many of the attendant advantages thereto will be readily appreciated as the same becomes better understood by reference to the following detailed description when considered in conjunction with the accompanying drawing wherein.

DESCRIPTION OF THE PREFERRED EMBODIMENTS

Figure 1:
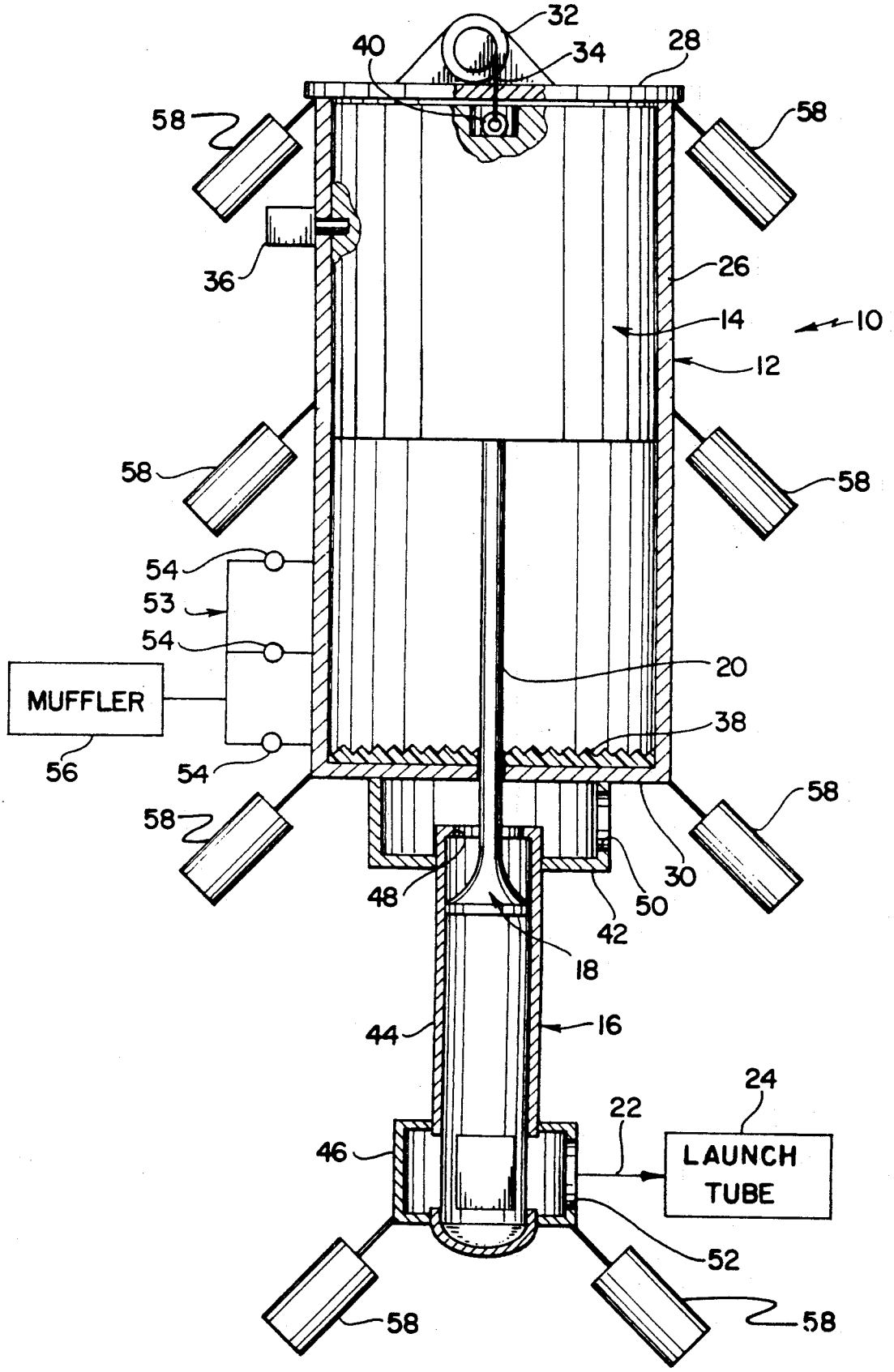
FIG. 1 is a schematic view of the apparatus of the instant invention.

Referring now to the drawing, the apparatus of the instant invention is illustrated and generally indicated at 10 in FIG. 1. The apparatus 10 comprises an enlarged first cylinder member generally indicated at 12, a first piston member generally indicated at 14 in the first cylinder member 12, a second cylinder member generally indicated at 16, a second piston member generally indicated at 18 in the second cylinder member 16, a connecting rod 20 mechanically connecting the first and second piston members 14 and 18, respectively, and a conduit 22 for connecting the second cylinder member 16 to a launch tube 24. The first and second cylinder members 12 and 16, respectively, are vertically oriented and the first and second piston members 14 and 18, respectively, are vertically movable in the first and second cylinder members 12 and 16, respectively. The second cylinder member 16 is adapted for receiving water in the upper end portion thereof, and the second cylinder member 16's lower end is connected to the breech end of the launch tube 24 through the conduit 22. The first piston member 14 is constructed so that it has a sufficient weight to gravitationally move the first and second piston members 14 and 18 downwardly in order to force water received in the lower end portion of the second cylinder member 16 outwardly through the conduit 22 and into the launch tube 24 with a sufficient amount of pressure to launch a device from the launch tube 24.

The first cylinder member 12 is of essentially cylindrical configuration, and it includes a side wall portion 26, a top wall portion 28, and a bottom wall portion 30. The first cylinder member 12 further includes a mechanical lifting mechanism 32 which is operative for mechanically lifting the first piston member 14 in the first cylinder member 12 with a cable 34. A mechanical locking device 36 is provided in the side wall portion 26 for mechanically retaining the first piston member 14 in the upper end portion of the first cylinder member 26. Provided at the lower end portion of the first cylinder member 12 is a cushioned pad 38 which is preferably made from a suitable rubberized material so that it is operative for cushioning the first piston member 14 as it contacts the bottom wall 30.

The first piston member 14 is slidably received in engagement in the first cylinder member 12 and it preferably constructed from a suitable metal in a sufficiently weighted construction to gravitationally move the second piston member 18 downwardly in the second cylinder member 16 in order to force water outwardly under high pressure from the second cylinder member 16 and into the breech end of the launch tube 24. In this connection, the first piston member 14 preferably has a weight of at least approximately 20,000 lbs. so that it can provide a sufficient force to adequately pressurize the water in the second cylinder member 16 to launch a 6 inch diameter device from the launch tube 24. The first piston member 14 is preferably constructed from a suitable metal, such as steel, and it is secured to the cable 34 with a suitable fastening member 40. The first piston member 14 is further adapted for receiving the locking member 36 in engagement therewith in order to releasably retain the first piston member 14 in the upper position thereof.

The second cylinder member 16 is disposed in vertically aligned relation with the first cylinder member 12, and it includes an upper housing section 42, a main cylinder side wall section 44, and a lower or outlet section 46. In this regard, although in the embodiment of the apparatus 10 herein set forth the second cylinder member is located beneath the first cylinder member 12, it will be understood that reverse positions of the cylinder members 12 and 16 are contemplated. In any event, the main cylinder section 44 is of elongated tubular configuration and it has a substantially smaller diameter than the first cylinder member 12. The main cylinder section 44 has an open upper end 48 and the upper housing section 42 is operative for securing the main cylinder section 44 to the bottom wall 30 of the first cylinder member 12 so that the main cylinder section 44 is in open communication with the housing section 42 through the open end 48. The upper housing section 42 has an inlet 50 formed therein which is preferably in open communication with the exterior of a submarine in which the apparatus 10 is mounted for supplying water to the upper end portion of the second cylinder member 16 as the second piston member 18 is moved downwardly. The outlet section 46 is attached to the lower end portion of the main cylinder section 44, and it is formed as an enlarged housing which is operative for supporting the second cylinder member 16 and for connecting the second cylinder member 16 to the conduit 22. The outlet section 46 has an outlet opening 52 formed therein which is connected to the conduit 22 for supplying pressurized water to the launch tube 22.

The second piston member 18 is received in substantially sealed engagement in the second cylinder member 16, and it is adapted so that it can travel vertically in the second cylinder member 16 for forcing water in the lower end portion of the second cylinder member 16 outwardly under relatively high pressure through the outlet opening 52 and into the breech end of the launch tube 24. The second piston member 18 is mechanically connected to the first piston member 14 through the connecting rod 20 so that the second piston member 18 is moved downwardly in the second cylinder member 16 as the first piston member 14 is moved downwardly in the first cylinder member 12.

The conduit 22 comprises conventional high pressure conduit and the launch tube 24 is preferably of conventional construction. The conduit 22 is sealingly connected to the housing 46 at the outlet opening 52 so that it is operative for conducting pressurized water to the breech end of the launch tube 24, and it preferably includes a suitable conventional isolation coupling for acoustically isolating the apparatus 10 from the launch tube 24. The launch tube 24 is adapted so that it is operative in response to the application of high pressure water to the breech end thereof for launching a device therefrom. Specifically, the launch tube 24 is adapted so that it is operative for launching a device therefrom in response to the application of water to the breech end thereof having sufficient pressure to overcome the water pressure surrounding a vessel in which the launch tube 24 is mounted.

A venting assembly 53 comprises a plurality of vent valves 54 which are operative for venting air from the lower half of the first cylinder member 12 as the first piston member 14 descends therein, and it further comprises a muffler 56 through which air from the valves 54 is vented. The venting assembly 53 is operative for selectively controlling the amount of air pressure in the lower end portion of the first cylinder member 12 in order to provide an air cushion for cushioning the first piston member 14 as it approaches the bottom wall 30. Accordingly, the venting assembly 53 is operative for controlling the speed at which the first piston member 14 impacts the cushion 38 as the first piston member 14 approaches the bottom wall 30.

The mounting assembly comprises a plurality of conventional shock-noise isolators 58 which are operative for mounting the apparatus 10 so that it is mechanically and acoustically isolated from the remaining portions of the submarine.

Accordingly, for use and operation of the apparatus 10, the piston members 14 and 18 are moved upwardly to the upper ends of their respective cylinder members 12 and 1 6 thereof utilizing the lifting mechanism 32, and the locking device 36 is moved into engagement with the first piston member 14. As the piston members 14 and 18 are drawn upwardly in this manner, water is drawn inwardly into the lower end portion of the second cylinder member 14 through suitable valving (not shown) in the conduit 22. In this connection, the entire available area in the lower end portion of the second cylinder member 16 is maintained filled with water at all times in order to more effectively inject water under pressure into the launch tube 24 as the second piston member 16 is moved downwardly. In any event, once the piston members 14 and 18 have been moved to the upper positions thereof, the locking device 36 can be released so that the first piston member 14 is gravitationally moved downwardly to force the water from the lower end portion of the second cylinder member 16 outwardly through the opening 52 and the conduit 22 and into the launch tube 24. As the pressure in the breech end of the launch tube 24 is increased to a level which is above that of the water surrounding the vessel in which the apparatus 10 is mounted, a device in the launch tube 24 is launched by the water pressure in the breech end thereof. As the second piston member 18 is moved downwardly in the second cylinder member 16 in this manner, water is drawn inwardly through the opening 50 into the upper housing section 42 and the upper portion of the second cylinder member 16. In addition, as the first piston member 14 is moved downwardly in the first cylinder member 12, the air pressure in the lower end portion of the first cylinder member 12 is controlled utilizing the venting apparatus 26 so that as the first piston member 14 approaches the wall 30 the air in the first cylinder member 12 operates to cushion the first piston member 14 as it is brought to rest.

It is seen therefore that the instant invention provides an effective apparatus for pressurizing a launch tube. The apparatus 10 is operative by utilizing gravitational force to apply pressure to water in the lower cylinder member 16 in order to pressurize the breech end of the launch tube 24. Hence, the apparatus 10 is operative without producing significant amounts of noise which would increase the acoustic signature produced when a device is launched from the launch tube 24. As a result, it is seen that the apparatus of the instant invention represents a significant advancement in the art.

Many alternatives exist for the present invention without deviating from the teachings herein, for example: the dimensions shown for the power stroke, water cylinder size, and weight and weight cylinder size could all change to provide a more effective system or to improve space effectiveness. A stroke and weight was selected simply to match the stroke and force associated with an existing system. Even if it is decided to maintain the water cylinder size and system stroke, the weight may change. This is due to the fact that in the existing system, air pressure drops to produce a lower than 20,000 pound force. However, the gravity launcher produces a uniform force which is more compatible with developing a constant acceleration of the device being launched. As this is a more efficient system, it is probable that a weight less than 20,000 pounds would be all that is required. A 20,000 pound weight was selected to launch a 6-inch diameter device. If the ejector is to have the dual capability of launching either a 3-inch or a 6-inch device, then the weight may be sectionalized so that less weight is used to launch the smaller device. Another alternative would be to reduce the system's stroke, simply by lowering the weight, prior to release.

FIG. 1 depicts an electric hoist to lift the weight to its elevated position. It may be more effective to utilize a hydraulic hoist or to use no hoist at all, as an air pressure over 13.1 psi below the weight will raise it to its upper position. FIG. 1 also shows the bleed off controls to effectively decelerate the weight before it completes its entire stroke. The number of valves was selected arbitrarily and their quantity may be increased, decreased, or possibly eliminated. The weight 14 is shown positioned above the water cylinder. This orientation could easily be reversed if it was decided to put the piston connecting shaft in elongation in lieu of compression while firing or if a reverse configuration was superior from a ship arrangement standpoint.

In the preferred embodiment tanks are used for piping connections to sea and to the ejection tube. These connections reflect only one possible configuration, and elbow fittings could be utilized or the flow from the water cylinder could by-pass the water piston at the end of stroke in lieu of being dissipated radically. While eight shock-noise isolators are shown, the actual quantity, size, and performance characteristics may be varied.

The attached sketch reflects a metal weight size which approximates 20,000 pounds for a constant force launch. This weight represents approximately a 39 cubic foot piece of metal, as many metals weight about 518 pounds per cubic foot. If the launch concept was utilized outside the pressure hull, then the size of the weight would have to be increased as it would be buoyed up by the weight of the fluid it displaces. If metal was used for the weight, this would result in a net weight of approximately 455 pounds per cubic foot in lieu of 518 pounds per cubic foot. The size of the weight would also be increased if lighter material was used (such as cement) or decreased if heavier material was used (such as depleted uranium).

The inventive concept could be used as a supplement to a conventionally powered system (with a much smaller weight) should a very quiet, low velocity launch be desired, or a launch when conventional power supplies were not available (i.e.: an emergency situation).

Therefore, while there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An apparatus for pressurizing a launch tube, of a submarine comprising:

a vertically disposed first cylinder member;

a weighted first piston member received in said first cylinder member for vertical movement therein between an upper first position and a lower second position;

a second cylinder member having opposite first and second end portions, said second end portion having an outlet therein;

a second piston member in said second cylinder member movable in substantially sealed relation between first and second positions therein, wherein said second piston member is shifted toward said first and second end portions, respectively, of said second cylinder member, whereby movement of said second piston member toward the second position thereof operates to apply pressure to a fluid received therein tending to urge the latter outwardly through said outlet;

connecting means connecting said first, and second piston members for movement together between the respective first and second positions thereof;

conduit means connecting said outlet to the breech end of said launch tube for pressure, zing the latter with said fluid upon movement of said first and second piston members toward the second positions thereof when said fluid is received in said second end portion of said second cylinder member; and said first and second piston members being constructed such that the weight of said first piston member is sufficient to gravitationally move said first piston member from the first position thereof to the second position thereof in order to pressurize said launch tube with said fluid.

2. In the apparatus of claim 1 said fluid comprising water.

3. In the apparatus of claim 1, said first cylinder member having a normally substantially closed lower end portion, said apparatus further comprising vent means for selectively opening said lower end portion to selectively control the descent of said first piston member.

4. In the apparatus of claim 1, said second cylinder member being vertically disposed, said second piston member being vertically movable in said second cylinder member.

5. In the apparatus of claim 4, said connecting means mechanically connecting said first and second piston members in vertically aligned relation.

6. The apparatus of claim 1, further comprising shock-noise isolator means for mounting said first and second cylinder members in a submarine so that said first and second cylinder members are substantially acoustically isolated therefrom.

7. In the apparatus of claim 2, said second cylinder member further comprising an inlet in the first end portion thereof for receiving water in the first end portion of said second cylinder member during movement of said second piston member toward the second position thereof.

* * * * *